US010889479B2

(12) United States Patent
Soussan et al.

(10) Patent No.: US 10,889,479 B2
(45) Date of Patent: Jan. 12, 2021

(54) BOTTLE OPENER CORK REMOVER

(71) Applicant: WINE UP LTD., Ramat Beit Shemesh (IL)

(72) Inventors: Nahman Soussan, Jerusalem (IL); Eliyauo Harrar, Ramat Beit Shemesh (IL); David Timsit, Raanana (IL)

(73) Assignee: WINE UP LTD., Ramat Beit Shemesh (IL)

( * ) Notice: Subject to any disclaimer, the term of this patent is extended or adjusted under 35 U.S.C. 154(b) by 146 days.

(21) Appl. No.: 16/044,535

(22) Filed: Jul. 25, 2018

(65) Prior Publication Data

US 2019/0031481 A1 Jan. 31, 2019

Related U.S. Application Data

(60) Provisional application No. 62/537,499, filed on Jul. 27, 2017.

(51) Int. Cl.
*B67B 7/08* (2006.01)

(52) U.S. Cl.
CPC ..... *B67B 7/08* (2013.01)

(58) Field of Classification Search
CPC ..... B67B 7/08; B67B 7/06; B67B 7/04
See application file for complete search history.

(56) References Cited

U.S. PATENT DOCUMENTS

| | | | | |
|---|---|---|---|---|
| 3,192,803 | A * | 7/1965 | Federighi | B67B 7/08 81/3.2 |
| 4,464,956 | A * | 8/1984 | Hashimoto | B67B 7/08 141/19 |
| 5,005,446 | A * | 4/1991 | Mackey | B67B 7/08 141/19 |
| 5,020,395 | A * | 6/1991 | Mackey | B67B 7/08 141/19 |
| 6,510,957 | B2 * | 1/2003 | Gilley | B65D 1/023 215/299 |
| 6,568,549 | B1 * | 5/2003 | Miller | B67B 7/0441 215/228 |
| 6,763,961 | B2 * | 7/2004 | Gardner | B65D 39/16 215/299 |
| 6,941,839 | B1 * | 9/2005 | Syu | B67B 7/08 81/3.2 |
| 9,446,936 | B2 * | 9/2016 | Kao | B67B 7/08 |
| 9,637,367 | B1 * | 5/2017 | Arnold | B67B 7/0405 |
| 9,845,231 | B2 * | 12/2017 | Hume | B67B 7/08 |
| 2003/0033907 | A1 * | 2/2003 | Lian | B67B 7/08 81/3.2 |
| 2005/0076741 | A1 * | 4/2005 | Chan | B67B 7/08 81/3.2 |

* cited by examiner

*Primary Examiner* — David B. Thomas
(74) *Attorney, Agent, or Firm* — Mark M. Friedman

(57) ABSTRACT

A device for removing a cork from a bottle, the device including: (a) a hollow needle, adapted to be inserted in the cork; and (b) pressurized gas sealed in an inner volume of a container; wherein the pressurized gas is adapted to be released from the container when a path of fluid communication is formed between a proximal end of the hollow needle and the inner volume of the container, such that the pressurized gas is channeled through the hollow needle, and into the cork or into the bottle, below the cork thereby forcing the cork out of the bottle.

19 Claims, 15 Drawing Sheets

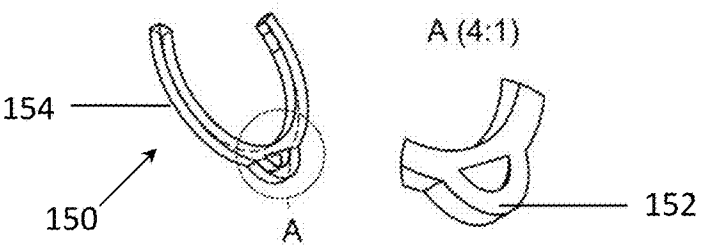
FIG. 6B
FIG. 6A
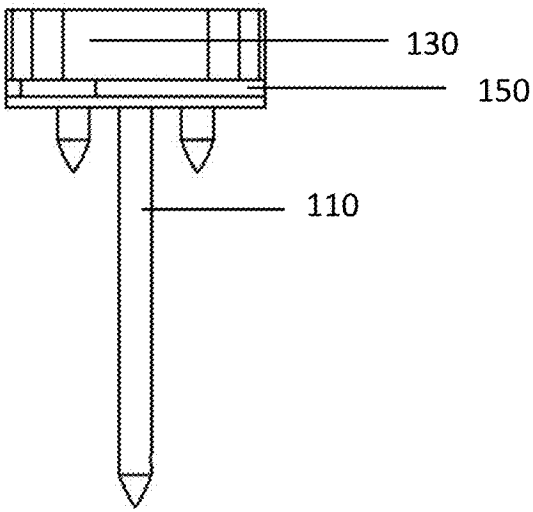
FIG. 2B
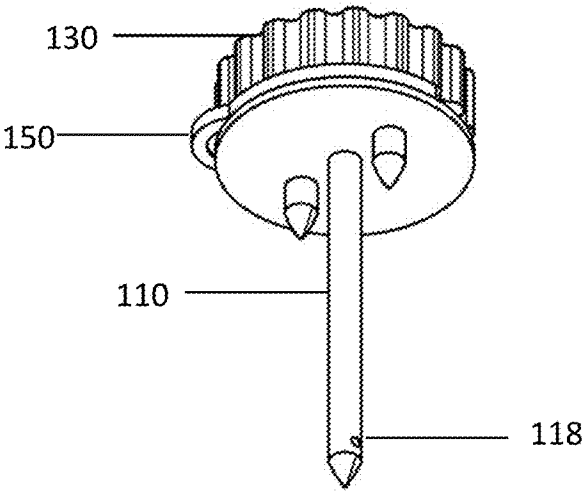
FIG. 2A

A–A (3:1)

B–B (2:1)

250
200
262
210

250
260
262
210
240
264
132
136

240
235
230
270
242
220
218
214

216
212
260
265
266
262
210

FIG. 11C
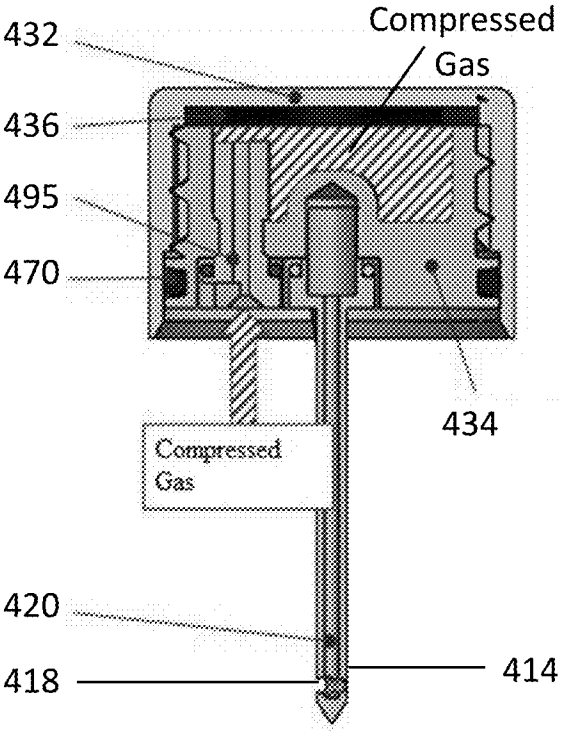
FIG. 11D
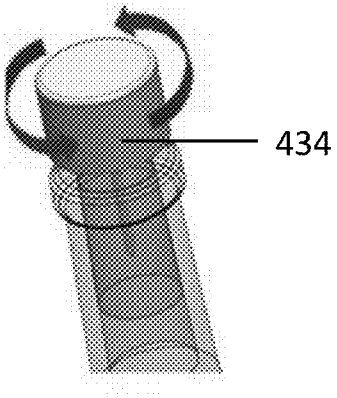
FIG. 11E
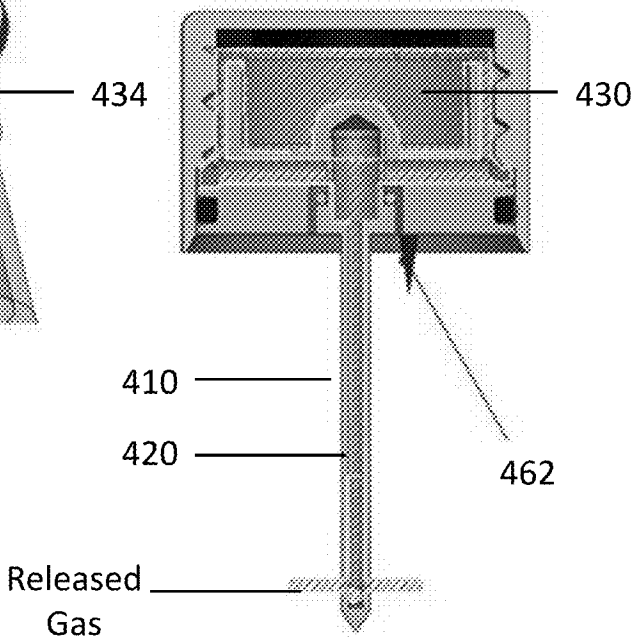
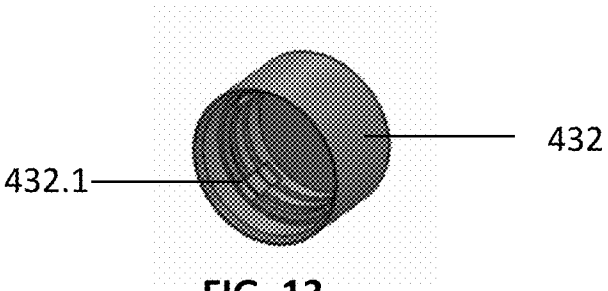
FIG. 13

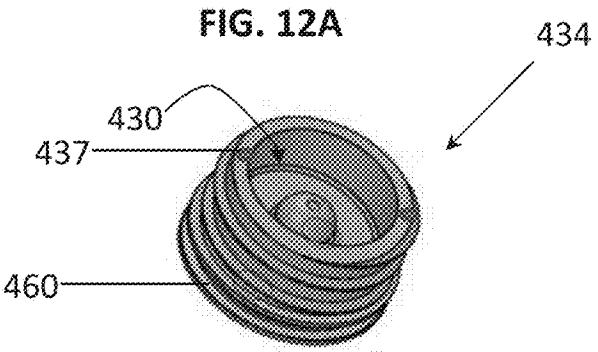
FIG. 12A
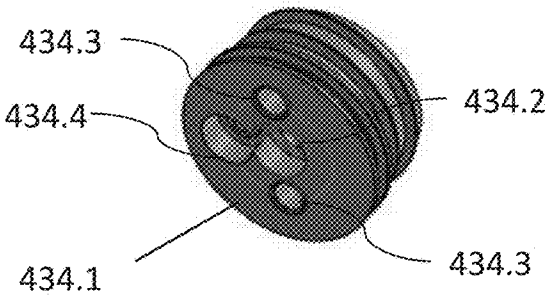
FIG. 12B
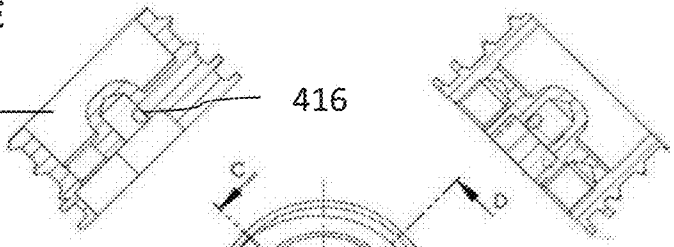
FIG. 12E
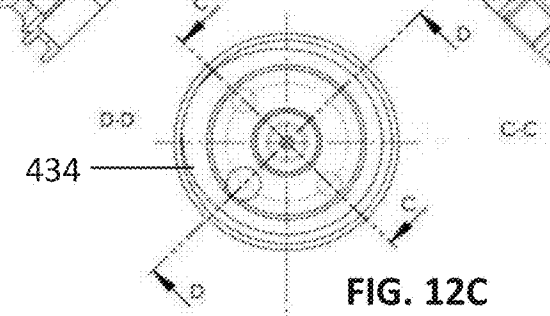
FIG. 12C
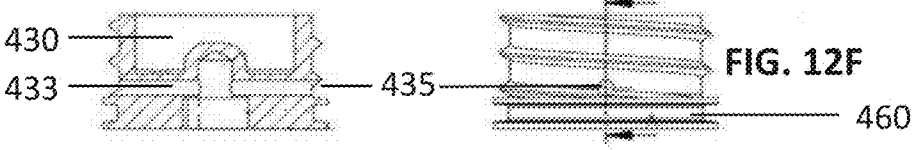
FIG. 12F
FIG. 12G
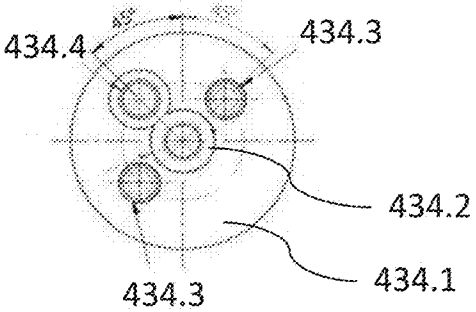
FIG. 12H
FIG. 12D

BOTTLE OPENER CORK REMOVER

This patent application claims priority from, and the benefit of U.S. Provisional Patent Application No. 62/537,499, filed Jul. 27, 2017, which is incorporated in its entirety as if fully set forth herein.

FIELD OF THE INVENTION

The present invention relates to a cork remover and, more particularly, to a retrofit apparatus, for single use, to remove a cork using compressed gas.

BACKGROUND OF THE INVENTION

Devices for removing corks using compressed air are known in the art. Some devices are multi-use devices that are adapted to remove corks from lots of different bottles. These devices are not attached to the cork but rather sold separately alongside cork screws and other bottle opening devices.

Specialty corks are also known in the art which include cork expelling mechanisms built into the corks themselves. However, such corks need to be installed at the time of corking the bottle and do not provide a solution for existing bottles with regular corks.

SUMMARY OF THE INVENTION

According to the present invention there is provided a device for removing a cork from a bottle, the device including: (a) a hollow needle, adapted to be inserted in the cork; and (b) pressurized gas sealed in an inner volume of a container; wherein the pressurized gas is adapted to be released from the container when a path of fluid communication is formed between a proximal end of the hollow needle and the inner volume of the container, such that the pressurized gas is channeled through the hollow needle, and into the cork or into the bottle, below the cork thereby forcing the cork out of the bottle.

According to further features in preferred embodiments of the invention described below the device further includes (c) a safety mechanism, adapted to prevent the release mechanism from being actuated. According to still further features in the described preferred embodiments the proximal end is sharp.

According to further features the hollow needle includes: a first opening at a proximal end of the hollow needle, a second opening at a distal end of the hollow needle, and a channel within the hollow needle connecting the first opening to the second opening, such that when released from the container, the pressurized gas enters the hollow needle via the first opening and exits the hollow needle via the second opening.

According to further features the device has a rest state and a release state, wherein in the rest state, a barrier interposes between the proximal end of the hollow needle and the inner volume, and in the release state the fluid path is formed between the inner volume of the container and the proximal end of the hollow needle, such that the pressurized gas is released from the container into the hollow needle.

According to further features the device is moved from the rest state to the release state by rotating the container about a threaded member until a barrier of the container is penetrated by the proximal end of the hollow needle.

According to further features the safety mechanism includes a safety member, the safety member positioned so as to prevent the container from being rotated sufficiently so as to be penetrated by the proximal end of the hollow needle.

According to further features the device further includes: a disk with a central aperture through which the proximal end of the hollow needle passes there-through; a spring biasing the disk towards the proximal end of the hollow needle; and an actuating member, such as a lever or rotary cap, adapted to push the container against the disk so as to move the disk away from the proximal end, moving the device from the rest state to the release state.

According to further features the container is a single use aluminum capsule and the proximal end of the hollow needle is sharp such that in moving to the release state, the proximal end punctures the single use aluminum capsule, thereby forming the path of fluid communication and releasing the pressurized gas.

According to further features the container includes a pressure valve and the proximal end of the hollow needle activates the pressure valve in the release state, thereby forming the path of fluid communication and releasing the pressurized gas from the container. According to further features the container is a refill-able container.

According to further features the container includes: an outer member; an inner member, and a washer, wherein the outer and inner members are adapted to be threadably engaged; optionally, with the washer disposed there-between; wherein the pressurized gas is disposed within the inner volume defined by the outer and inner members; and wherein the inner member includes the barrier located facing the proximal end of the hollow needle.

According to further features the barrier is a selected from the group including: an aluminum sheet, a rubber barrier, a metal diaphragm, and an impermeable membrane.

According to further features the device further includes an anchoring means for anchoring the hollow needle against rotation about an axis of the hollow needle.

According to further features the hollow needle is coupled to a needle holder and wherein the anchoring means includes at least two spikes extending from the needle holder, the at least two spikes adapted to be inserted into the cork when the hollow needle is inserted into the cork.

According to further features the anchoring means includes spines disposed along an outer surface of the hollow needle, the spines adapted to prevent the hollow needle from rotating once inserted into the cork.

According to further features the hollow needle has an elongated body of a shape selected from the group including: a triangular shape, square shape, oblong shape, pentagonal shape, hexagonal shape.

According to further features the container includes an outer member; and an inner member, the outer and inner members threadably engaged; wherein the pressurized gas is disposed within an inner volume defined by the outer and inner members; and wherein unscrewing the outer member from the inner member forms the path of fluid communication and releases the pressurized gas from the inner volume.

According to further features the path of fluid communication includes a flow path between internal screw threads of the outer member and external screw threads of the inner member and a tunnel leading from the space flow path to an opening in the proximal end of the hollow needle.

According to further features the path of fluid communication includes at least one borehole disposed in a rim of inner member, connecting with a tunnel in a base of the inner member, the tunnel in fluid communication with the proximal end of the hollow needle.

BRIEF DESCRIPTION OF THE DRAWINGS

Various embodiments are herein described, by way of example only, with reference to the accompanying drawings, wherein:

FIG. 2A-2B are views of a diagram of the first embodiment;

FIGS. 6A and 6B are views of the safety clasp;

FIG. 11C-11E are progressive views of actuation of the fourth embodiment;

FIG. 12A-H are various views of the internal member of device 400;

FIG. 13 is a bottom isometric view of the outer member 432.

DESCRIPTION OF THE PREFERRED EMBODIMENTS

The principles and operation of a device for removing a cork from a bottle according to the present invention may be better understood with reference to the drawings and the accompanying description.

Figure 1A:
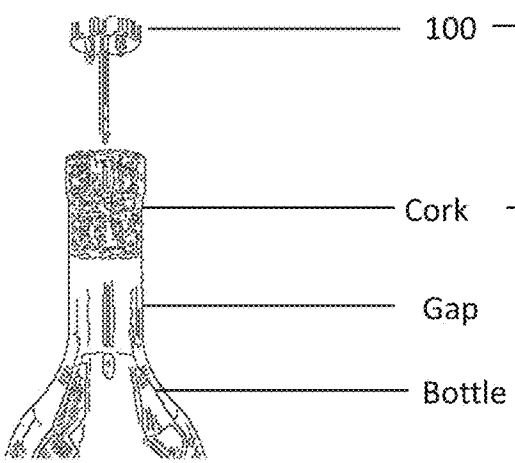
FIG. 1A-1D are views of a first embodiment of the invention.
Figure 1B:
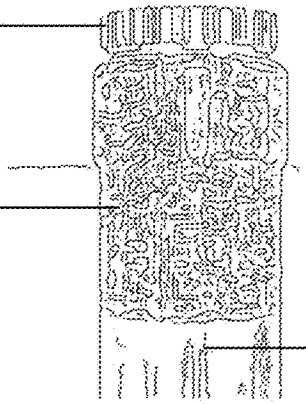
Figure 1C:
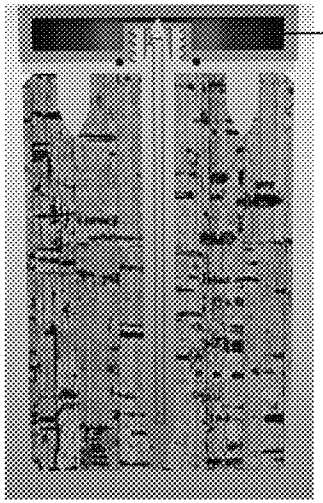
Figure 1D:
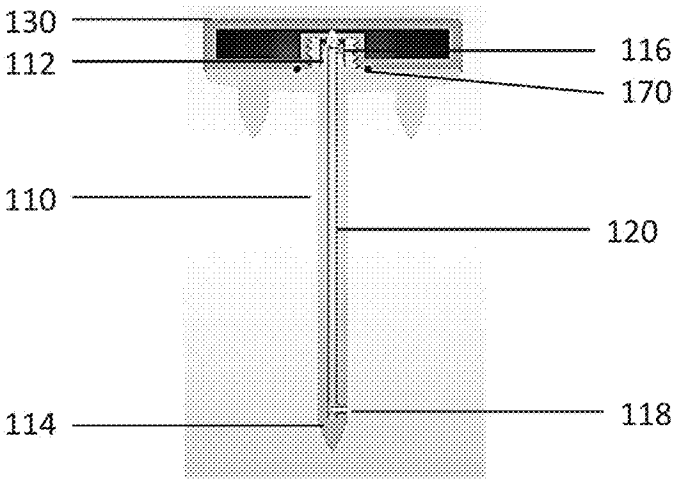

Referring now to the drawings, FIGS. 1A to 1D illustrate various views of an embodiment of the innovative cork remover. FIG. 1A illustrates the device 100 of the invention poised to be inserted into a cork in a bottle. FIG. 1B illustrates device 100 already inserted into the cork. FIG. 1C is a cross-sectional view of the device 100 inserted into a cork. FIG. 1D is a cross-sectional view of the device 100.

The cork remover device 100 is a standalone device that can be inserted into the cork of a bottle either during the manufacturing process or post manufacture. For example, during the manufacturing process, the fluid is bottled in a bottling plant/process and then corked. After corking, the top and neck of the bottle are often covered with a plastic and/or metallic safety cover or decorative packaging. In one embodiment, the innovative cork remover 100 is inserted into the cork before the safety cover/packaging is fixed over the top of the bottle.

In another embodiment, the bottle is corked and packaged in the regular manner and dispersed to the retailers. The consumer buys the bottle from a store. After removing the packaging (plastic and/or metallic safety cover) the consumer inserts the cork remover into the cork. According to the embodiment of the invention depicted in FIGS. 1A to 1D, the device is activated by twisting the top of the device. Further details are provided hereafter. Once activated, the device releases compressed/pressurized gas into the cork (or below the cork), building pressure between the fluid and the bottom of the cork until the cork is forced out of the bottle (or at least far enough out of the bottle neck to be easily removed by hand).

FIGS. 2A and 2B are various views of an embodiment of the cork remover 100. FIG. 2A is an isometric bottom view of device 100. FIG. 2B is a front view of the device 100.

Referring now to FIGS. 1A-1D and 2A-2B, the device 100 for removing a cork from a bottle includes three basic components: a hollow needle 110, a container 130 housing pressurized gas and a needle holder 160 with a means or mechanism from connecting the hollow needle to the pressurized gas inside the container, thereby releasing the gas into the needle. In preferred embodiments, the device also includes a safety mechanism 150 that prevents accidental actuation of the release mechanism.

The hollow needle 110 is inserted into the cork and the container and release mechanism remain outside the cork. The hollow needle can be inserted anywhere between halfway through the cork and all the way to the bottom edge of the cork. In some embodiments, the needle can protrude through the bottom surface of the cork. For the sake of clarity, the bottom of the cork is the surface disposed inside the bottle neck, facing the fluid. The top of the cork is the surface facing the open air once the packaging is removed. The needle is inserted into the top of the cork. The container and needle holder lie above the top surface of the cork.

Figures 3A, 3B, 3C:
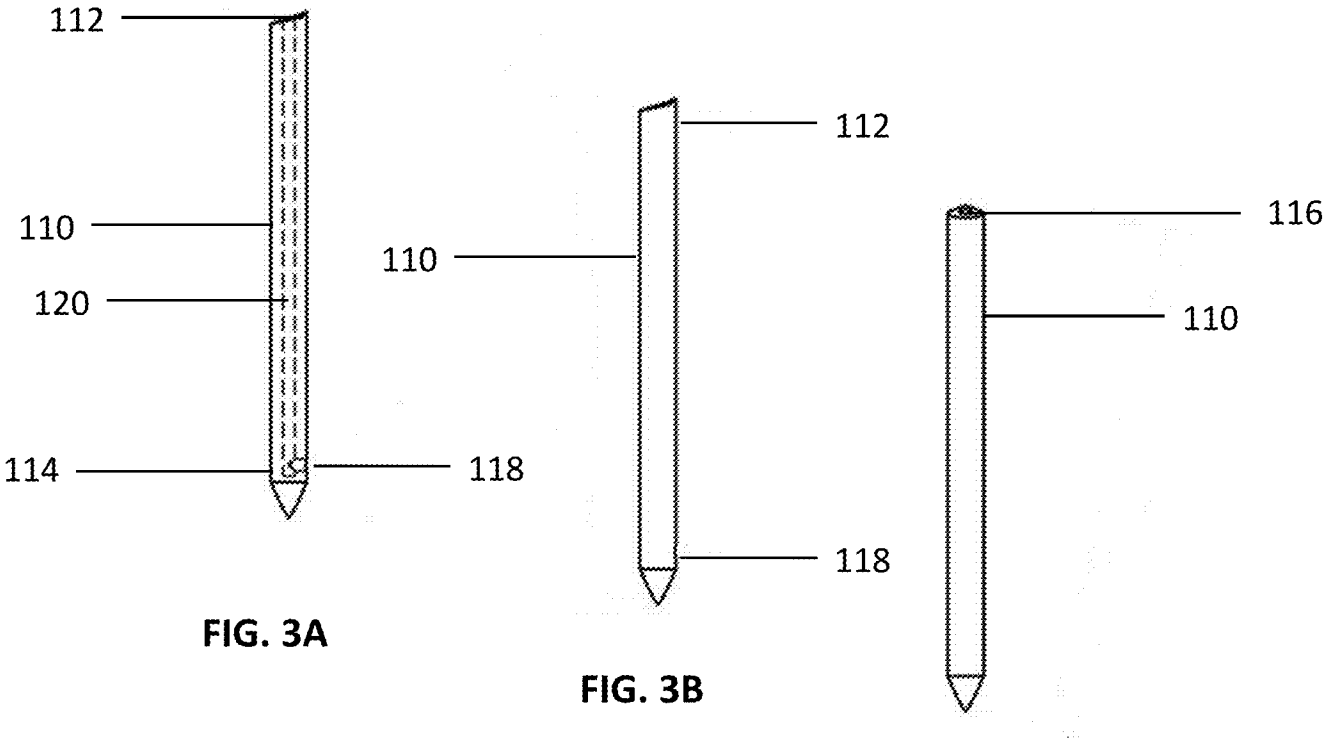
FIG. 3A-3C are views of the needle of the invention.

FIGS. 3A to 3C are various views of the hollow needle 110. FIG. 3A is a side view of needle 110 with internal components depicted with broken lines. FIG. 3B is a regular side view of needle 110. FIG. 3C is another side view of needle 110 with an opening shown in the needle. In some embodiments the needle is a regular, elongated cylindrical shape. In other embodiments, the body of the needle is an elongated triangular shape. The triangular shape prevents the needle from being rotated once inserted into the cork. Other optional shapes include, but are not limited to a square shape, oblong shape, pentagonal shape, hexagonal shape or any other multifaceted shape.

Referring to all of FIGS. 1A to 3C, the hollow needle 110 includes a proximal end 112 and a sharp distal end 114. According to the instant embodiment, the proximal end is also sharp. (The sharp proximal end of the needle is used to puncture a barrier that seals the pressurized air inside the container, as will be discussed in greater detail below.) The needle 110 has a first opening 116 at a proximal end of the hollow needle and a second opening 118 at the distal end 114 of the hollow needle 110. The first opening 116 is clearly shown in FIG. 3C and also seen in FIGS. 1C and 1D. The second opening is clearly seen in FIG. 3A as well as FIGS. 1C and 1D. The hollow needle has a channel 120 running the length of the hollow needle. In FIG. 3A the internal channel 120 is depicted in broken lines. The internal channel is clearly depicted in FIGS. 1C and 1D which are cross-sectional views of the needle.

The channel connects the first opening 116 to the second opening 118, such that when the pressurized gas 131 is released from the container 130, the pressurized gas enters the hollow needle via the first opening 116, flows down the channel 120 and exits the hollow needle via the second opening 118. The pressurized/compressed gas flows into the cork and out into the gap between the cork and the fluid. Pressure builds in the gap (which already contains air or nitrogen or some other inert gas, in most cases) and forces the cork out of the bottle neck. The compressed gas may be any type of gas including, but not limited to: air, nitrogen, helium and the like.

Figure 4B:
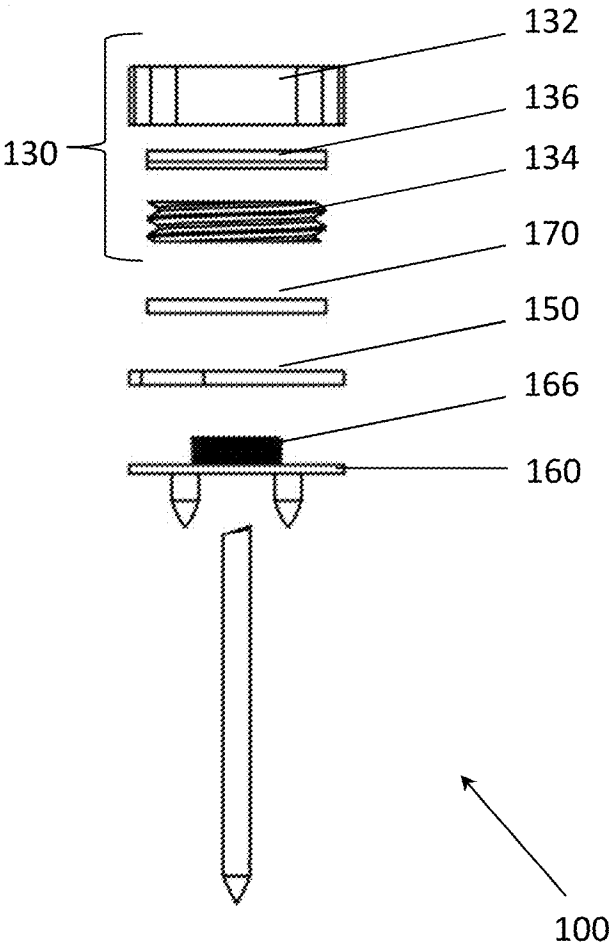
FIG. 4A-4B are exploded views of the first embodiment.
Figure 4A:
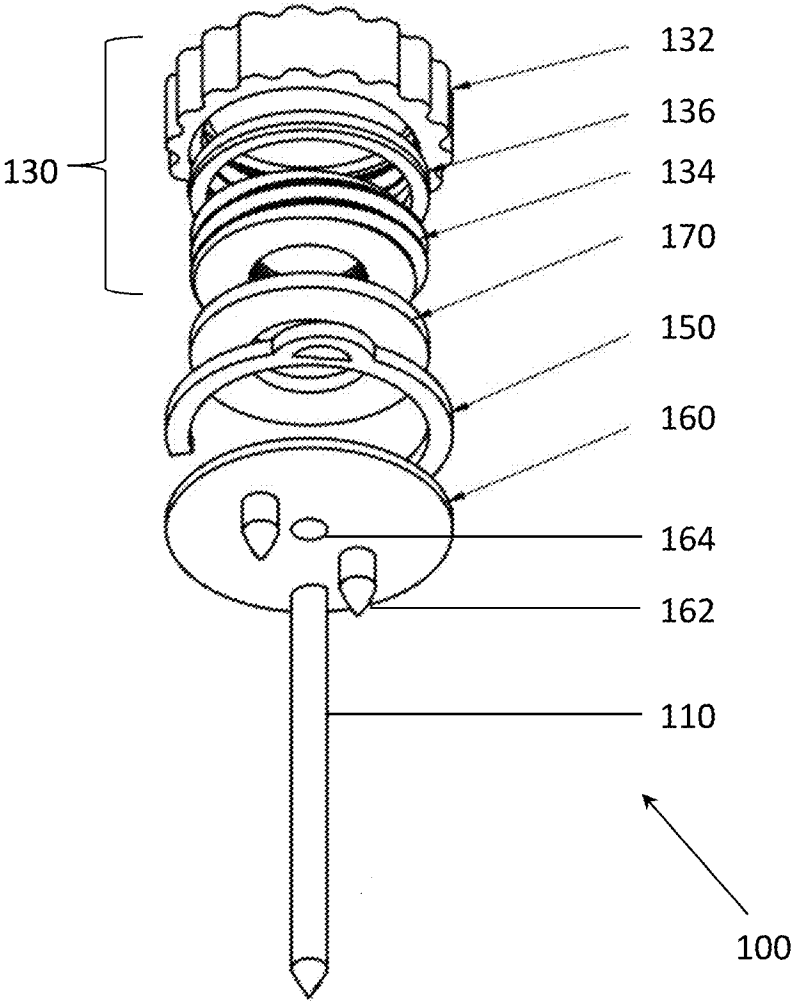

FIG. 4A is an isometric exploded view of the device 100 for removing corks. FIG. 4B is a front exploded view of the device 100 for removing corks. Referring to both FIGS. 4A and 4B, according to the present embodiment, device 100 includes a hollow needle 110 coupled to a casing. The hollow needle 110 passes through an opening 164 in the center of needle holder 160 such that the proximal end of the needle extends through the top side of the plate 160. The needle is held firmly in place in the central opening 164 of the needle holder 160.

The device 100 further includes an anchoring means for anchoring the hollow needle, and indeed the entire device 100, from rotating about the axis of the hollow needle. Needle holder 160 includes anchoring means in the form of two short spikes 162 (in other embodiments, additional spikes may be included) which are formed on the bottom surface of the needle holder and extend downwards therefrom. The bottom surface of the needle holder 160 is the surface that comes into contact with the top of the cork when the needle is inserted into the cork. The anchoring spikes 162 also bite into the cork when the needle is fully inserted into the cork. Preferably, each of the spikes is situated on a different side of the needle (so that the sharp points of the spikes and the needle make a straight line when viewed from the bottom). Once the spikes have been sunk into the cork, the device will not rotate. This is especially important for embodiments with a release mechanism that is actuated by twisting a portion of the device, as is the case in the instant embodiment.

Alternatively or additionally, the anchoring means may include spines or teeth protruding from the body of the needle. In one embodiment, such spines or teeth prevent the needle from twisting around inside the cork (e.g. in an embodiment without the aforementioned spikes 162). In another embodiment, the spines or teeth additionally, or alternatively, prevent the needle from being pulled out of the cork. As mentioned above, another anchoring means can be the shape of the needle. For example, the elongated body of the needle may be triangular (instead of cylindrical, which is the regular shape of the needle). An elongated triangular hollow needle will not easily rotate within the body of the cork.

Referring again to needle holder 160, a threaded member 166 extends from the top surface of the needle holder 160. The threaded member 166 is circular and has larger diameter than the needle 110 and hole 164 in the plate. The height of the threaded member 166 is shorter than the height of the portion of proximal end of the hollow needle that protrudes out of the top side of the holder 160. Therefore, the sharp proximal end of the needle protrudes above the threaded member. Threaded member 166 is part of the mechanism for releasing the gas and will be discussed in greater detail below. At this point it is sufficient to explain that the container is brought into contact with the proximal end of the needle by screwing the container down the threaded member until the desired contact is achieved.

Above the needle holder 160 is a safety clasp 150 which is the safety mechanism of the instant embodiment of the invention. FIG. 6A is an isometric view of safety clasp 150. FIG. 6B is a magnified view of area A of FIG. 6A. When the safety clasp 150 is in place, the container 130 cannot be brought into contact with the proximal end of the hollow needle. The safety clasp is sandwiched between the container 130 and the circular plate of needle holder 160. The safety clasp is a thin band 154 with a pull tab 152 formed thereon. Preferably the safety clasp is made of plastic. The band 154 does not surround the entire circumference of the bottle neck so it is easily removed by pulling on the tab 152.

Above the safety clasp 150 is an O-ring 170 (also referred to as a gasket or rubber washer). When the gas is released, the O-ring 170 prevents the pressurized gas from escaping out of the device 100 in any other direction except through the channel of the hollow needle. The role of the gasket will become clearer once the mechanism of release has been explained.

Above the gasket are three members which, together, form the container 130 that holds the pressurized gas. The container 130 of the instant embodiment includes an outer member 132, an inner member 134, and a washer 136. The outer member is the element of the device that is held by the user to actuate the release mechanism. The outer member threadably engages with the inner member. The outer member has an internal thread. The inner member has a corresponding external thread. The outer member and inner member threadably engage to form the container that holds the pressurized gas within a volume defined by the outer and inner members. Generally, the outer and inner members are sealed with pressurized gas therein at the time of manufacture. In preferred embodiments, the outer and inner members are adapted to be threadably engaged with the washer 136 disposed there-between. In some embodiments, there is no washer between the outer and inner members.

Figure 5A:
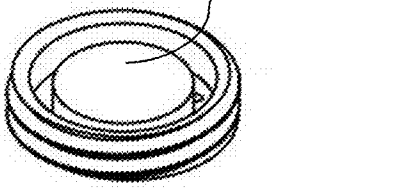
FIG. 5A-5E are various views of the inner member of device 100.
Figure 5B:
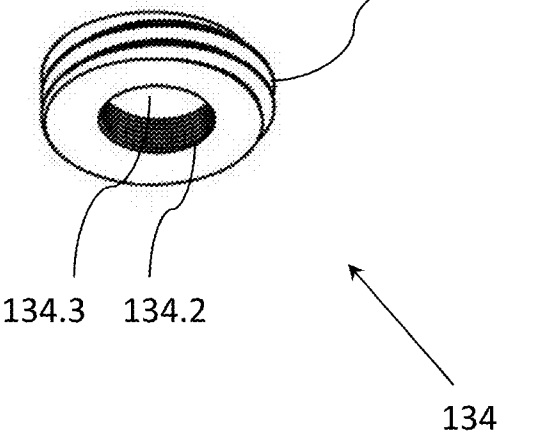
Figure 5C:
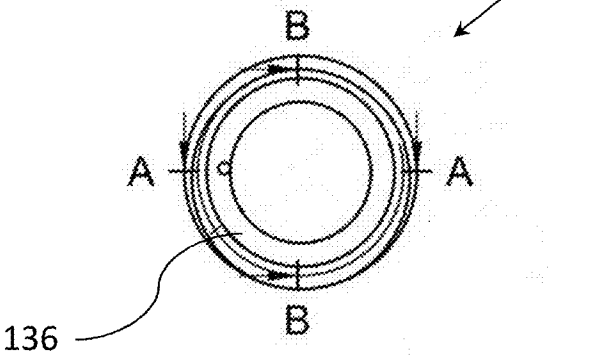
Figure 5D:
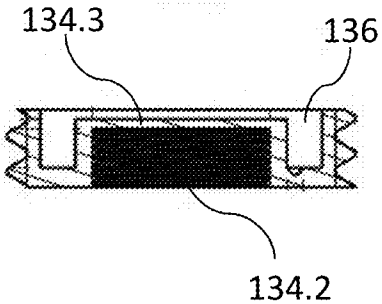
Figure 5E:
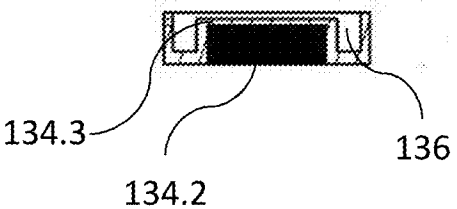

FIG. 5A is a top isometric view of the inner member 134. FIG. 5B is a bottom isometric view of the inner member 134. Inner member 134 has an external thread 134.1 with which the outer member 132 engages. The washer 136 is not shown in FIG. 5A, however, there is a space between the internal circle (explained hereafter) and the thread where the washer is inserted (in embodiments including a washer). FIG. 5C is top view of the inner member 134 with the O-ring/washer 136 inserted in place. FIG. 5D is a cross-sectional view of the cutaway A-A including the external thread 134.1. FIG. 5E is a cross-sectional view of the cutaway B-B excluding the external thread. O-ring 136 ensures that pressurized gas does not escape when the container is sealed. In some embodiments, there is no O-ring.

Inner member 134 has a flat circular barrier 134.3 which is most clearly visible in FIGS. 5A and 5C. The barrier 134.3 is also referenced in the cross-sectional views of FIGS. 5D and 5E. The flat barrier 134.3 may be made of an aluminum foil sheet, a rubber barrier, a diaphragm, or any other impermeable membrane. Below the barrier 134.3, inner member 134 has an internal thread 134.2 which corresponds to the external thread of threaded member 166 (which protrudes from the plate of needle holder 160). When the container is in place, i.e. threadably coupled with the threaded member 166 (at the top of the screw thread), barrier 134.3 faces the sharp proximal end of the hollow needle which protrudes above the threaded member 166.

The dynamic (movable) part of the release mechanism is container 130 and the static part of the release mechanism is the threaded member 166 and the sharp proximal end of the needle that protrudes above the threaded member. The movable part (container 130) is adapted to be rotated down the external thread of static part (threaded member 166) until the sharp proximal end 112 of the needle 110 penetrates the barrier of the container. Actuating the release mechanism is performed by simply gripping the outer member 132 of the container and twisting (rotating/revolving) the container down the screw thread 166 until the container rotates down the threaded member sufficiently for the protruding portion of the sharp proximal end of the needle to penetrate, perforate, puncture or otherwise pass through the barrier 134.3.

Every embodiment of the invention has a mechanism for releasing the pressurized gas in such a manner that the pressurized gas forces the cork out of the neck of the bottle. The device has two general states: a rest state and a release state. The device is in the rest state from the time of manufacture until the gas is released from the container. The rest state is defined as the state wherein the container with the pressurized gas is sealed. In most cases this is when the container is separated from the proximal end of the hollow needle. Said another way, the rest state is the state wherein no path of fluid communication exists between the internal volume of the container (with the pressurized gas) and the opening of the needle. By contrast, the release state is the state wherein a path of fluid communication exists between the internal volume of the container (with the pressurized gas) and the opening of the needle.

When the release mechanism is actuated or effected, the device moves from the rest state to the release state. In the release state, the container is brought into contact with the proximal end of the hollow needle such that a path of fluid communication is created and the pressurized gas is released from the container into the hollow needle via this path. In the instant embodiment, as described above, the device is moved from the rest state to the release state by rotating the container 130 about threaded member 166 until barrier 134.3 of the container is penetrated by the sharp proximal end 112 of hollow needle 110.

The barrier may be a foil/aluminum diaphragm which is punctured by the sharp proximal end of the needle. Once punctured, the container is no longer usable. Therefore, a container with such a barrier is a single use container. The barrier may alternatively be made of steel or polymer, In other embodiments, the barrier may be made of a rubber substance similar to the rubber material on the tops of test tubes and medicine vials. This rubber material can be penetrated by a sharp object like a needle and still remain fluid and gas impermeable after the needle is removed. Such a rubber material may allow multiple penetrations by the sharp end of the needle, making the device reusable.

Once the container/barrier is punctured, the compressed/pressurized gas escapes the container into the void between the container and the needle holder 160. Gasket 170 ensures that the gas does not escape outside the device. The pressurized gas will follow the path of least resistance and flow (forcefully) through the opening 116 at the proximal end 112 of the needle 110 and down channel 120, to exit the needle at opening 118. The gas flows into the space (gap) between the cork and the fluid, building up the pressure. With nowhere to go, the released gas forces the cork out of the neck of the bottle.

Figures 7A, 7B, 7C, 8:
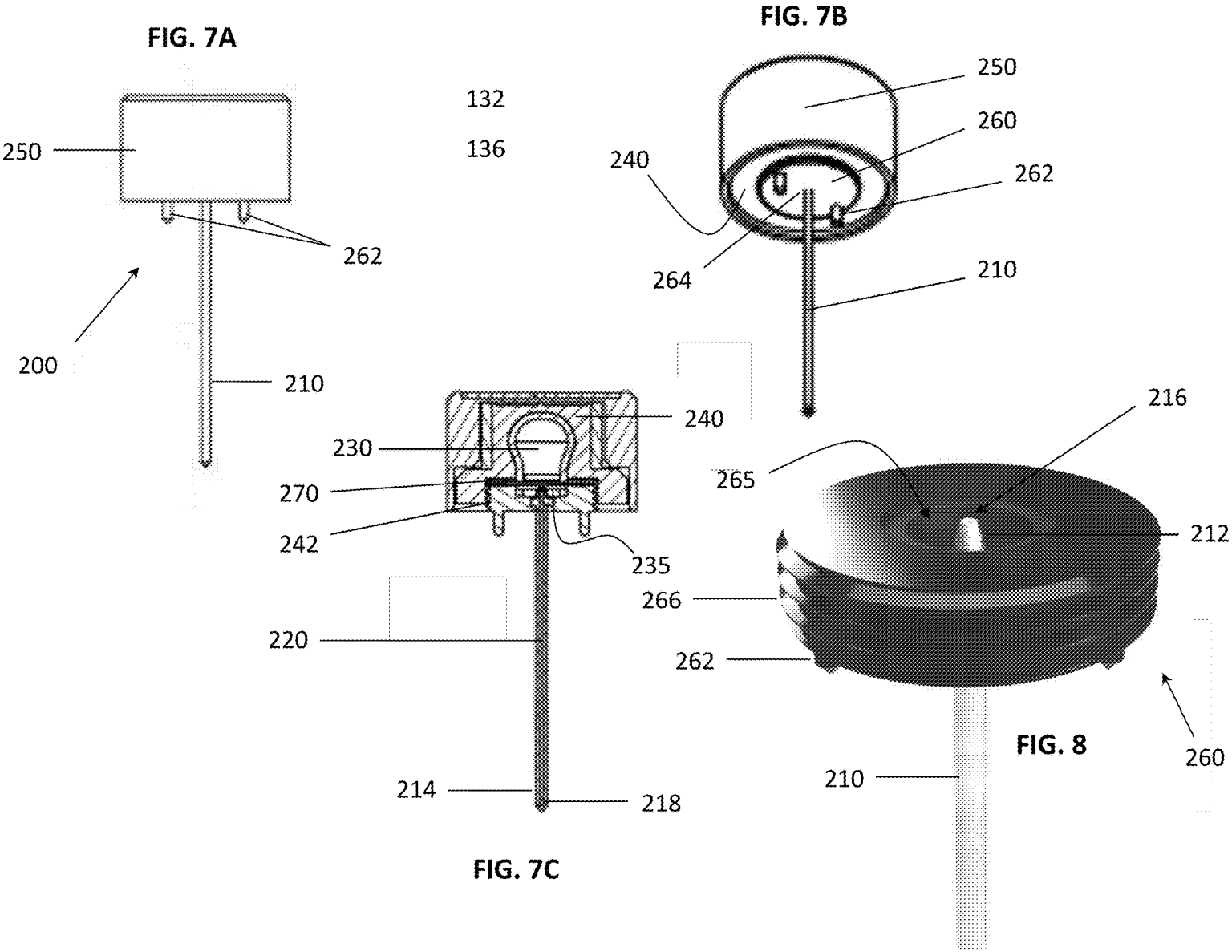
FIG. 7A-7G are various views of a second embodiment of the invention.
FIG. 8 is a top isometric view of a pictorial illustration of holder 260 with needle 210 inserted therein.

Another possible configuration is shown in FIGS. 7A to 7G. FIG. 7A illustrates a side view of a second embodiment of the invention. FIG. 7B is a bottom isometric view of device of FIG. 7A. FIG. 7C is a cross sectional view of the device of FIG. 7A. FIGS. 7A, 7B and 7C, illustrate a cork removing device 200. Device 200 is similar to device 100, with minor changes. Like device 100, device 200 includes a needle 210. Needle 210 has an opening 216 on a proximal end 212 of the needle (see FIG. 8). There is a second opening 218 on a distal end 214 of the needle. A channel 220 runs through the middle of needle 210 and operationally connects opening 216 to second opening 218 affording fluid communication between the three components.

The proximal end 212 of needle 210 is operationally coupled to a needle holder 260. FIG. 8 is a top isometric view of a pictorial illustration of holder 260 with needle 210 inserted therein. Holder 260 is circular with an external threading 266 on the outer circumference. Two spikes 262 protrude downwardly (i.e. in the same direction as the distal point of the needle) from holder 260. The spikes serve to anchor the device 200, once they are inserted into the cork. A gasket 270 may optionally be disposed on top of holder 260. Holder 260 has an opening 264 through which needle 210 is threaded. Holder 260 has another opening 265, which is wider that opening 264. The proximal end of the needle 210 protrudes out of opening 265. Holder 260 is surrounded by an external screw thread 266.

In contrast to device 100, device 200 includes a bell-shaped capsule 230 containing compressed gas. The capsule 230 has a flat barrier 235 at the bottom of the capsule. In a rest state the barrier interposes between the proximal end of the hollow needle and an inner volume of the capsule containing the gas. The proximal end 212 of needle 210 is capable of penetrating barrier 235 and puncturing the capsule 230. Capsule 230 is made of a metal or polymer such as steel, aluminum, plastic and the like.

Capsule 230 is operationally coupled to housing 240. Housing 240 includes an internal threading 242 that corresponds to the external threading 266. The gas is released from the device 200 by twisting housing 240 so that the housing descends the threading 266, thereby pushing the capsule downwards, until proximal end of the needle punctures the flat barrier at the bottom of the capsule. Puncturing the barrier forms a path of fluid communication between the inner volume of the capsule and the hollow needle. The compressed gas rushes out of the capsule and follows the fluid path from opening 216 at the top of the needle, through channel 220 and out the second opening 218 at the bottom of the needle. In a similar fashion to that which was described with reference to device 100, the gas released from the capsule of device 200 expels the cork from the bottle.

Device 200 includes a safety cover 250 which is affixed over housing 240. The safety cover 250 is the safety mechanism that prevents the accidental release of the compressed/pressurized gas from the capsule. Safety cover 250 prevents a user from rotating or twisting housing 240 in a fashion that will effect the release of the gas from the capsule.

Figure 7G:
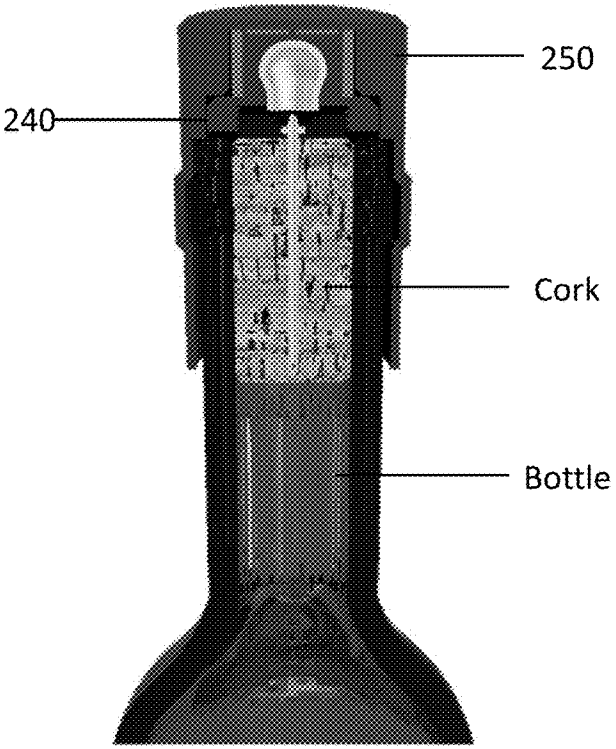
Figure 7D:
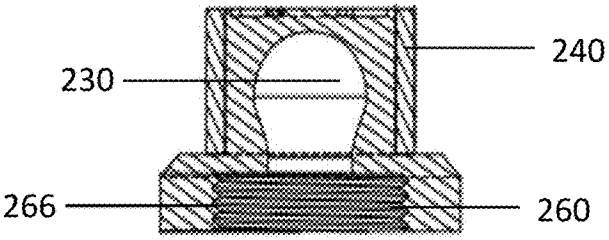

FIG. 7D is a cross-sectional view of device 200 without the safety cover 250. FIG. 7E is an isometric raised view of device 200, without the safety cap, inserted into a cork. Once a cork is removed from a bottle, the lower part of the cork is usually bloated, and therefore difficult to reinsert into the bottle if desired (e.g. the bottle is not empty). Usually, the cork is rotated and the dry end of the cork (which is not bloated) is used to stop up the bottle. In some embodiments, the housing 240 is made from, or coated with, silicone or similar material. The housing is constructed to dimensions such that the housing fits into the mouth of the bottle. Thus, after being opened, the cork, with device 200 inserted therein, can be rotated and inserted back into the mouth of the bottle. The housing (actually the device as a whole) is thereby used as a stopper or temporary corking member. The cork is not generally considered part of the invention (here and elsewhere throughout the document), but merely used for illustrative purposes to demonstrate the function of the devices.

Figure 7F:
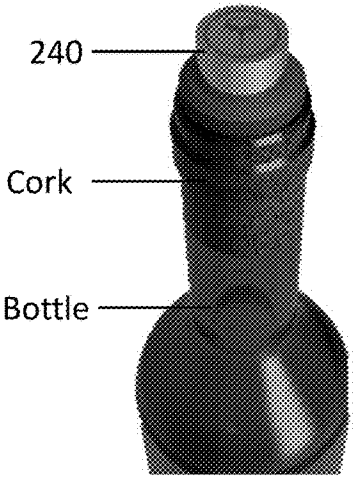
Figure 7E:
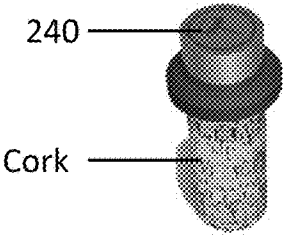

FIG. 7F is an isometric raised view of the device inserted in a cork disposed with in a bottle. FIG. 7G is a cross-sectional view of device 200 inserted in a cork in a bottle, with safety cover 250 placed over the exposed portion of the device and part of the neck of the bottle. The safety cover 250 must be removed to gain access to the housing 240 which can then be activated by twisting the housing, thereby causing the proximal end of the needle to penetrate the capsule and release the gas that forces the cork from the neck of the bottle.

Any detail, description or component mentioned with reference to one embodiment of the invention is intended to apply mutatis mutandis to all the other embodiments, unless specifically expressed otherwise. Therefore, all the details described for a component of one embodiment also apply to the same, similar or equivalent components in other embodiments, even when such detail is not set forth expressly for each embodiment.

Figure 9B:
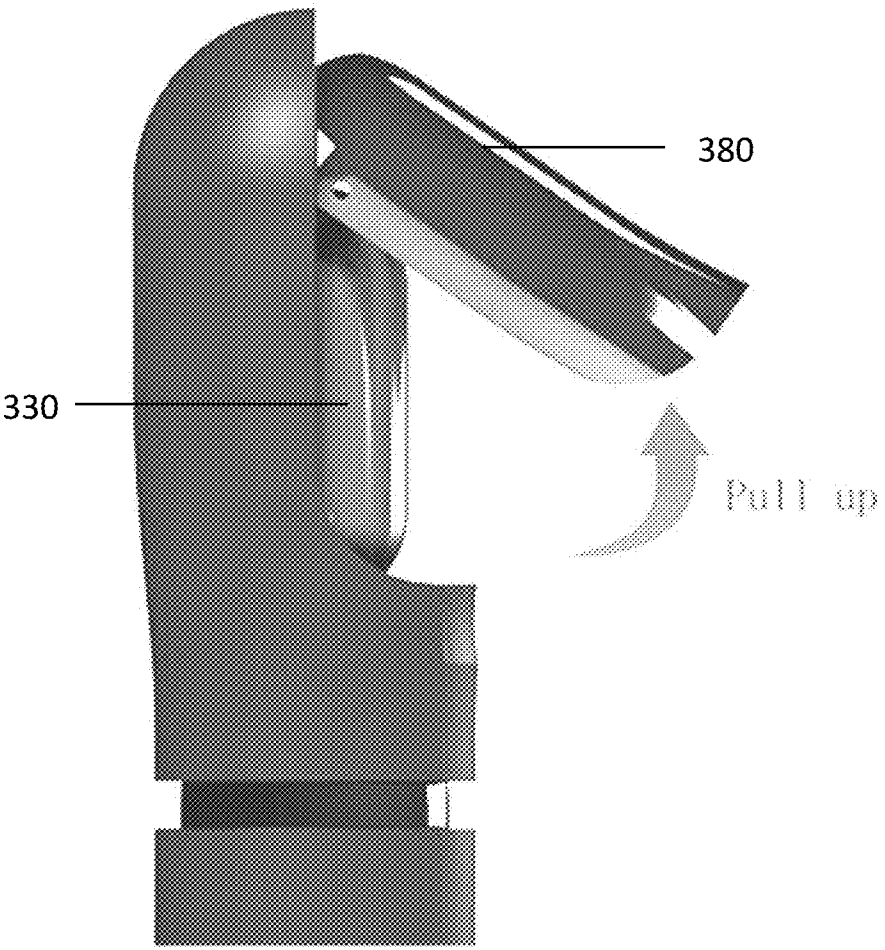
FIG. 9A-9D are various views of a third embodiment of the invention.
Figure 9A:
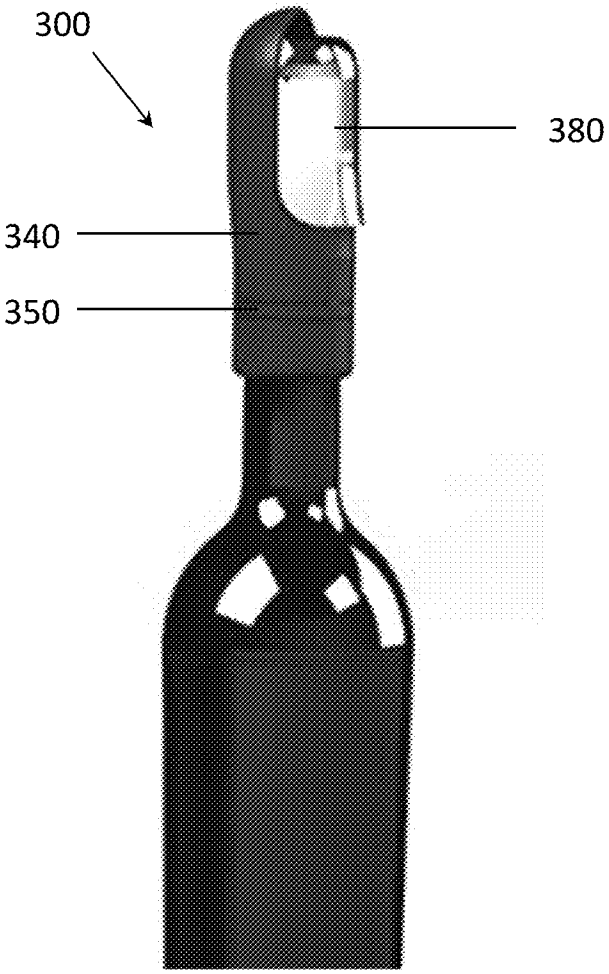
Figure 9C:
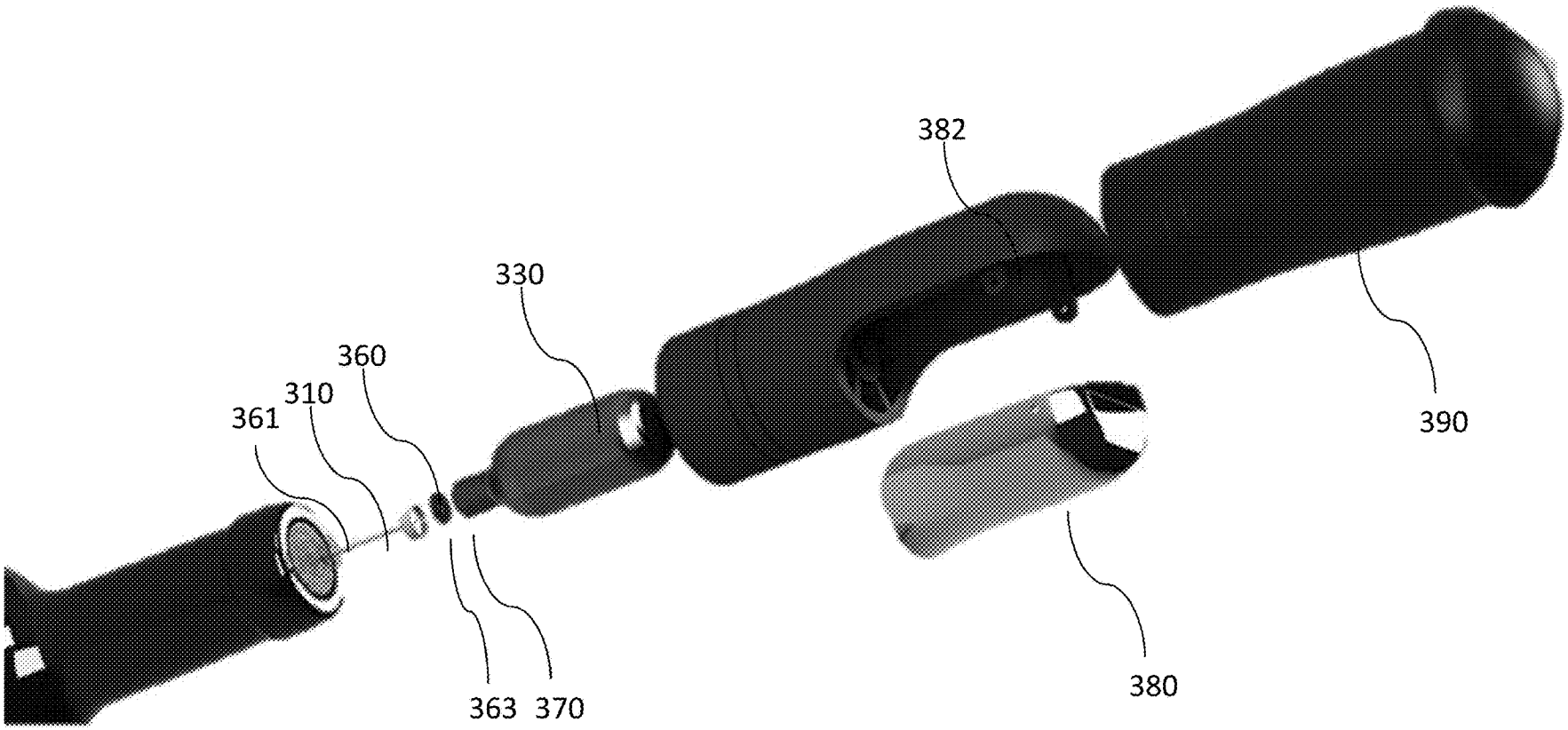
Figure 9D:
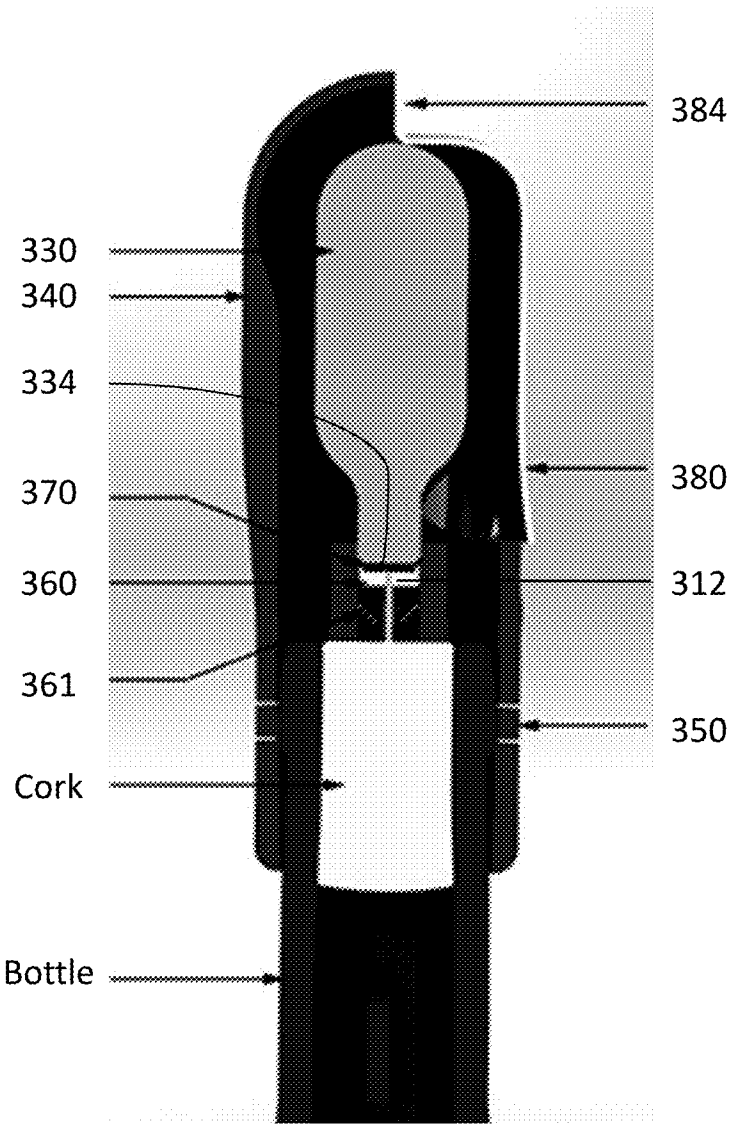

Yet another configuration is shown in FIGS. 9A to 9D. FIG. 9A is a side view of a device 300 installed over the opening of fluid bottle. A housing 340 holds the components of device 300. A lever 380 is used to effect the release of pressurized gas from a gas canister 330 (shown in FIGS. 9B, 9C and 9D). A safety band 350 is also visible in FIG. 9A. FIG. 9B illustrates the device 300 in the process of actuation. The safety band 350 is removed and the lever 380 is partially raised. FIG. 9C is an exploded view of device 300. FIG. 9D is a cross-sectional view of device 300.

Referring to all of FIGS. 9A, 9B, 9C and 9D, device 300 includes a needle 310 which is similar in form and function to the needles of devices 100 and 200 described above. For example, needle 310 has an upper opening at the proximal end of the needle, a lower opening at the distal end of the needle and a channel fluidly connecting the upper and lower openings. Device 300 does not, however, have an anchoring element which prevents rotation of the device when the needle is inserted in the cork. This is because the release mechanism is effected laterally, as opposed to rotationally (which is the method used for actuating devices 100 and 200).

On the proximal end of the needle 310, a disk 360 is slidably engaged with the needle. A proximal end 312 of the needle 310 passes through a central opening in the disk, such that the proximal end protrudes out the top side of the disk 360. A spring 361 is interposed between the top of the cork and the bottom surface of disk 360. The top surface of the disk has a lip 363 which runs around the circumference of the disk. A washer 370 is seated abutting the top surface of disk 360, within the lip 363 of disk. The proximal end of the needle does not protrude above the lip or gasket. In the rest state, a barrier (of the canister) interposes between the proximal end of the needle and the inner volume of the canister.

A capsule 330 containing compressed or pressurized gas is positioned above the gasket. At the bottom of the capsule is a barrier 334 which abuts the gasket 370. Lever 380, in the instant exemplary embodiment, has a protuberance at the open end of the lever. Using the tip of a finger, a user is a raise the lever, to swing about the fulcrum 382. A packaging cover 390, is exemplarily depicted in FIG. 9C.

Lever 380 is arranged such that when the lever is raised and rotates about the fulcrum 382, the top edge 384 of the lever angles downwards, pushing the capsule towards the cork. The canister 330 presses down on the gasket 170 which in turn pushes the disk 360 towards the cork. The disk 360 is slidably arranged on the needle 310 and moves towards the cork, compressing the spring 361. The proximal end 312 of the needle engages the bottom end of the canister.

In one embodiment, the bottom end of the canister is a diaphragm made from aluminum or steel material. When the lever is raised the barrier 334 is thrust onto the proximal end of the needle which punctures the barrier, releasing the gas. Thus, in the release state a path of fluid communication is formed between the inner volume of the canister/container and the proximal end of the needle. The gasket 370 prevents the released gas from exiting the device. With nowhere else to go, the released gas flows into the upper opening, through the channel and out the lower opening of the needle. The gas exiting the needle builds pressure between the fluid in the bottle and the cork. As a result of the building pressure, the cork is forced up the bottle neck, and in some cases, out of the bottle.

In another embodiment, the barrier is made from a rubber material that is permeable by sharp objects in one directions but remains impermeable to gas and fluid from the other direction. When the sharp proximal end of the needle penetrates the rubber barrier, the pressurized gas escapes through the hollow body of the needle and exiting out the lower opening in a similar fashion to that described above. Such a canister may be reusable once the canister has been refilled with condensed gas. In such an embodiment, the device 300 can be used multiple time, refilling the canister when the gas is depleted.

In yet another embodiment, the bottom of canister holds a pressure valve. When pressure is applied on the valve, the gas is release through the valve (in a similar fashion to the action of depressing a nozzle on a deodorant can, which releases a burst of aerosolized fluid) and into the opening 312 of the needle. When pressure is no longer exerted by the lever, the valve closes, preventing more gas from escaping. In such an embodiment, the device 300 can be used multiple time, refilling the canister when the gas is depleted. As mentioned elsewhere herein, all the variations, optional components, modifications etc. that are mentioned for any one of the embodiments described herein are also intended to apply to all the other embodiments as if fully set forth for each embodiment.

Figure 10B:
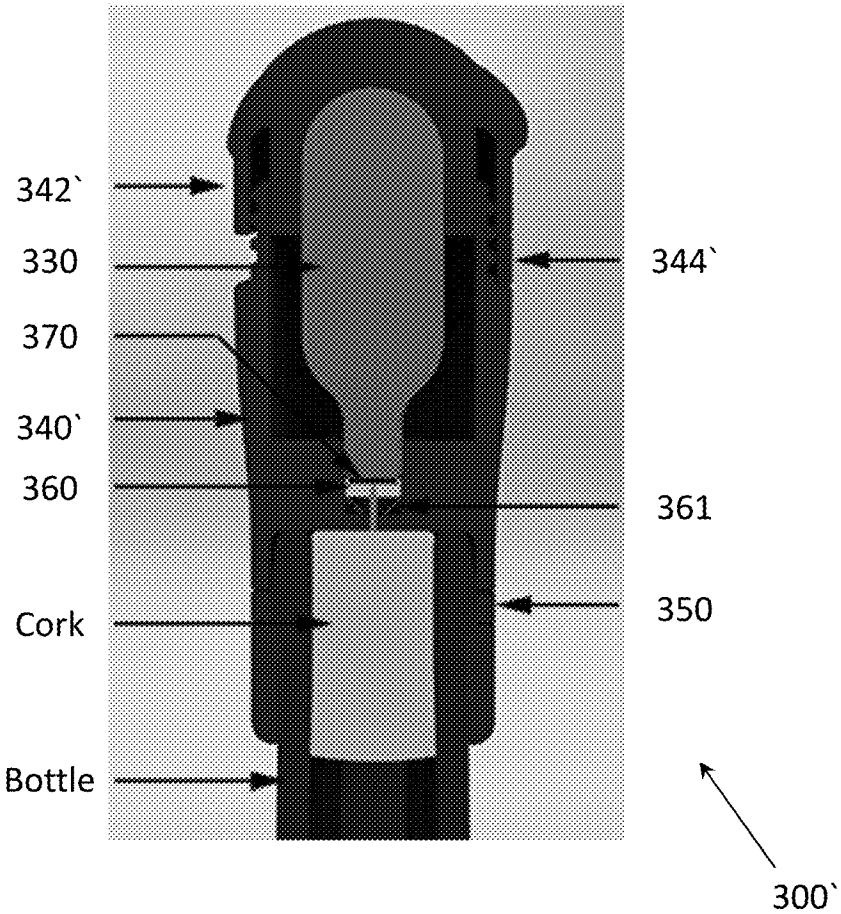
FIG. 10A-10C are various views of an alternative configuration of the third embodiment of the invention.
Figure 10A:
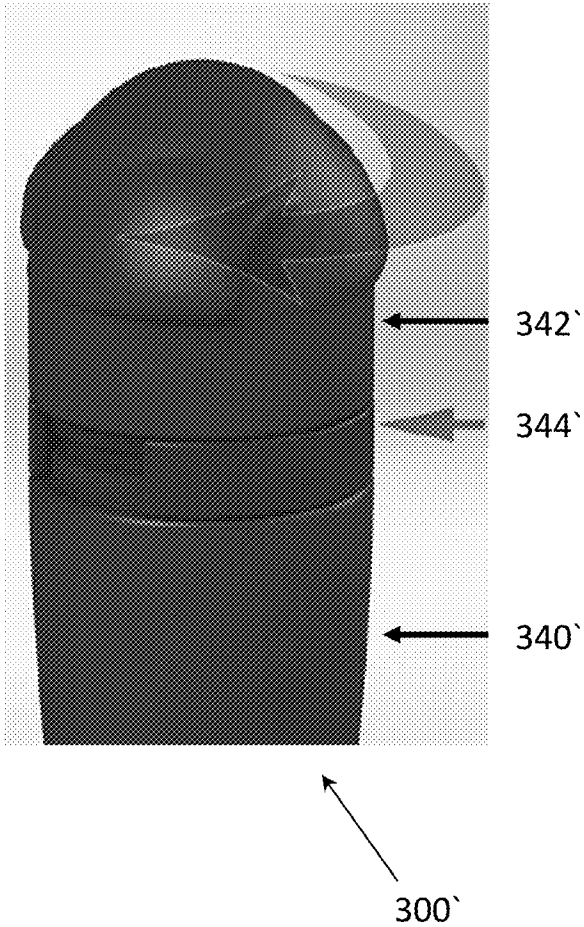
Figure 10C:
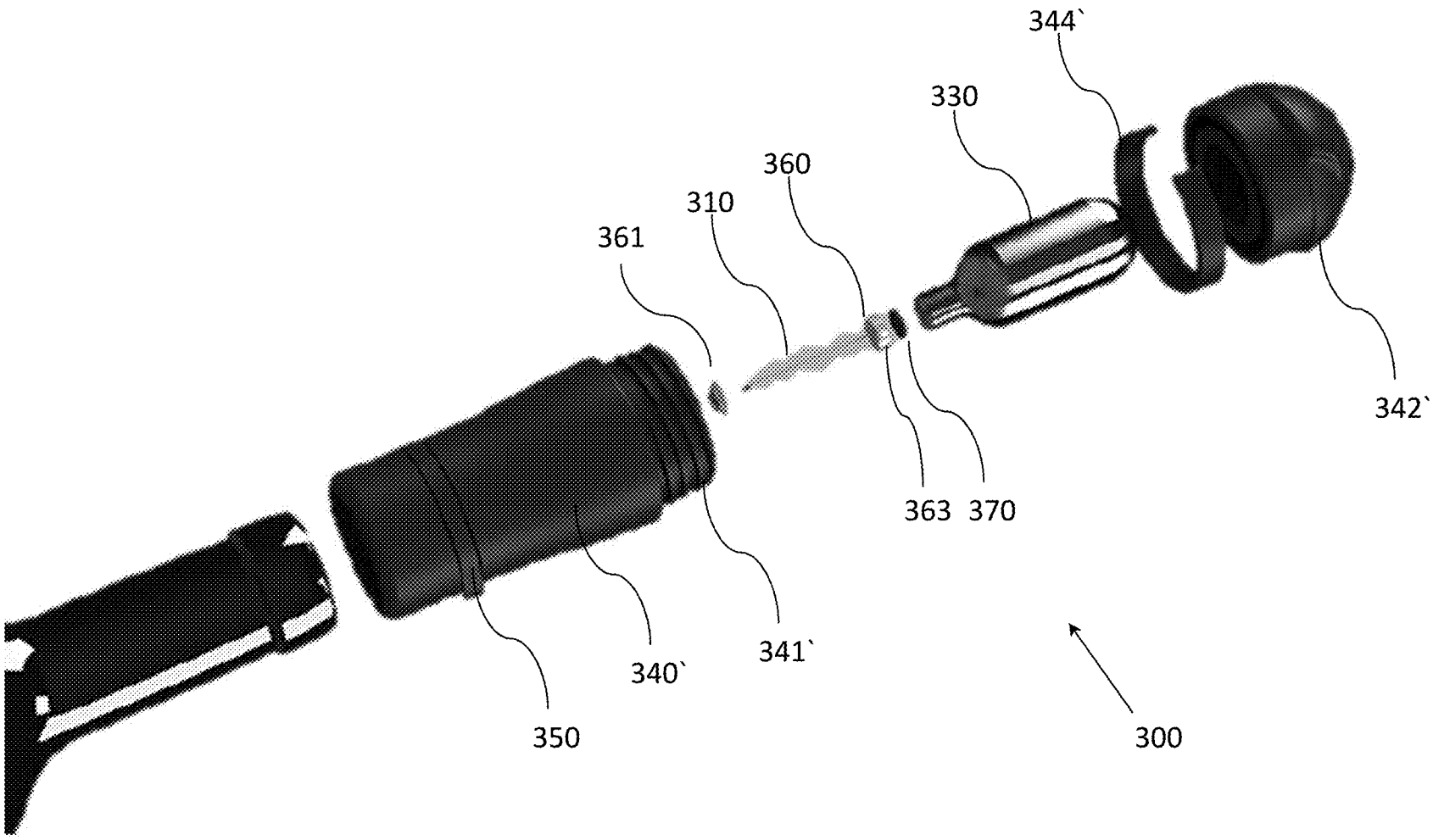

A slight variation of the previous embodiment is shown in 10A-10C. A device 300' is shown in FIGS. 10A-10C. FIG. 10A is a view of the top end of the device, showing the direction of rotation of the rotary head/cap of the device. FIG. 10B is a cross-sectional view of the device inserted in a cork in a bottle neck. FIG. 10C is an exploded view of the device 300'. Device 300' has the same internal mechanism as device 300, however the actuation mechanism is different. All components shared between device 300 and device 300' share the same reference numbers. The explanation of the working of device 300' is the same as that of device 300 but is not repeated for sake of brevity, except for the actuation mechanism which is explained here-after.

Device 300' includes a housing 340' with an external screw thread 341'. A rotary head 342' is threadably coupled to housing 340'. A safety band 344' is interposed between the rotary head 342' and housing 340', preventing the rotary head from being screwed down completely onto the housing. In a first step the safety clasp 344' is removed from the device. The second safety device 350 also needs to be removed before the device can be actuated. Once both safety elements have been removed, the rotary head 342' is rotated anti-clockwise, forcing the capsule downwards. The internal workings of the spring, disk, capsule etc., are the same as described above and therefore not repeated for sake of brevity. As such, in the rest state, a barrier (of the canister) interposes between the proximal end of the needle and the inner volume of the canister and in the release state a path of fluid communication is formed between the inner volume of the canister/container and the proximal end of the needle.

Figure 11B:
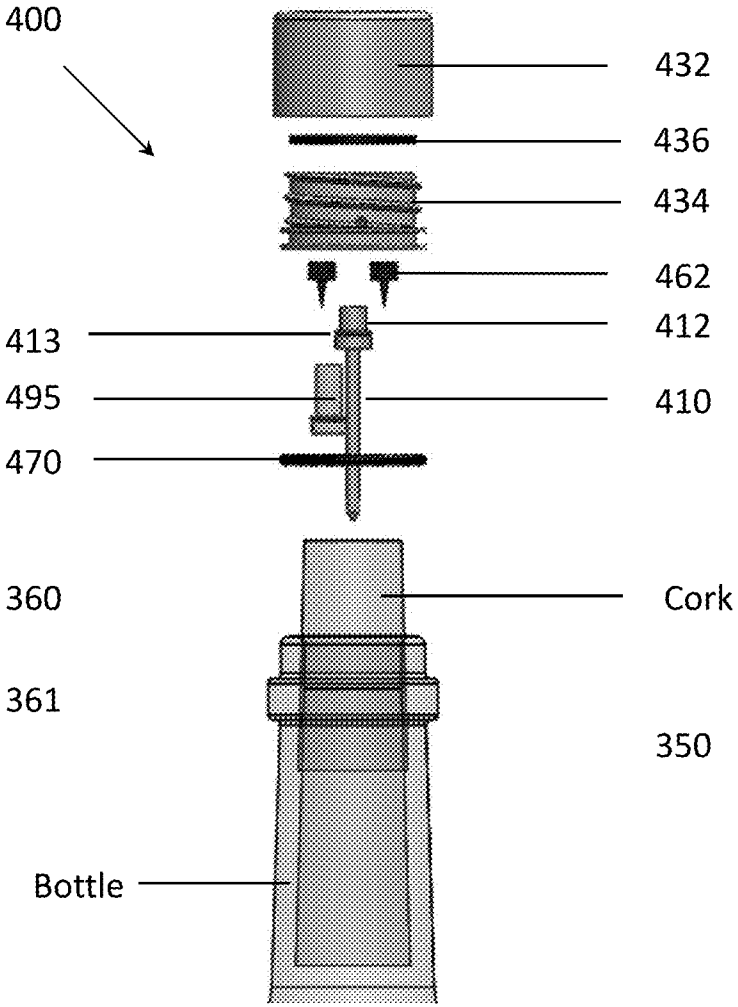
FIG. 11A-11B are various views of a fourth embodiment of the invention.
Figure 11A:
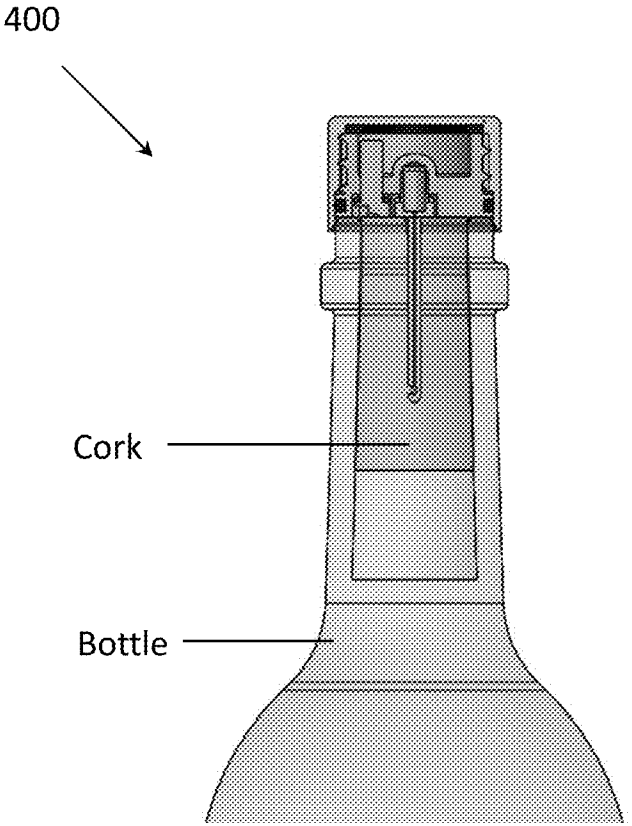

Yet another configuration is shown in FIGS. 11A to 11E. FIG. 11A is a cross-sectional view of the device 400 inserted into a cork which is disposed inside a bottle. FIG. 11B is an exploded view of the device 400. FIGS. 11C and 11E are cross sectional views. FIGS. 11C, 11D and 11E depict a progression from a rest state to a release state. In FIG. 11C the device 400 is in a rest state, in which compressed gas is sealed inside a compartment or container. In FIG. 11E, the device 400 is depicted in the release state, in which the compressed gas is being released from the compartment or container and is flowing through the hollow channel within the needle. FIG. 11D depicts the mechanism for releasing the gas. The mechanism moves the device from the rest state to the release state. In the rest state, a barrier (outer member closed over the inner member in an airtight seal) interposes between the proximal end of the needle and the inner volume of the container. In the release state a path of fluid communication is formed between the inner volume of the container and the proximal end of the needle. In the figure, the arrows indicate the direction in which the device cap must be rotated in order to release the gas. As is evident, the cap is simply rotated in the regular anti-clockwise direction and manner (for opening a regular bottle top), resulting in the gas being released and the cork being expelled.

As with devices 100, 200, 300 and 300', device 400 also includes a needle 410 and a container comprised of an outer member and an inner member. The instant embodiment includes an outer member 432 that covers over the top of the device and an inner member 434. The outer and inner members each have corresponding threads and are threadably engaged. A flat rubber seal or liner 436 is interposed between the outer and inner members. In embodiments the flat rubber liner 436 is a separate member and in other embodiments the flat rubber liner 436 is formed together with outer member 432 during manufacture, e.g. in an injection molding process. The liner may be made of a material other than rubber, such as silicone or any other appropriate synthetic polymer. The top edge of the outer member (together with the liner) form an airtight barrier over the inner volume of the inner member.

Inner member 434 is shown in greater detail in FIGS. 12A to 12H. FIG. 12A is a top isometric view of the inner member 434. FIG. 12B is an isometric bottom view of inner member 434. Inner member 434 defines a volume in which pressurized gas is contained. FIG. 12C is a top-down view of inner member 434. FIG. 12D is a cross-sectional view C-C of FIG. 12C. FIG. 12E is a cross-sectional view D-D of FIG. 12C. FIG. 12F is a side view of inner member 434. FIG. 12G is a cross sectional view A-A of FIG. 12F. FIG. 12H is a bottom view of inner member 434.

As can be seen best in FIG. 12H (but also in FIG. 12B), there are four openings in a bottom wall 434.1 of the inner member. One of the openings is optional, and therefore is not intended to be included in all embodiments. A proximal end 412 of needle 410 fits into the central opening, 434.2. As can be seen best in FIG. 11B, the proximal end of needle 410 has a larger diameter than the rest of the needle. A gasket 413 is fastened around the end portion of the needle. The proximal end 412 fits into opening 434.2 in an airtight coupling, as a result of the gasket. When the gas is released from the internal volume of inner member 434, the gas enters an opening 416 (seen for example in FIG. 12E) in the proximal end of the needle. The gas then flows down a central bore 420 within the body of the needle and exits the needle at a distal opening 418 disposed on a distal end 414 of the needle 410. The gasket 413 prevents the gas from escaping out of central opening 434.2.

In some embodiments, the inner member 434 and needle 410 are formed together in a manufacturing process, e.g. injection molding, such that the needle is held in the inner member in an airtight manner, obviating the need for gasket 413 and separately formed opening 434.2. Therefore, gasket 413 is only an optional component, and may not be found in all variations of the instant embodiment.

Two openings 434.3 on facing sides of central opening 434.2 house anchoring spikes 462, seen best in FIG. 11B. In some embodiments, spikes 462 are formed together with inner member 434 at production, and not as separate components. In such embodiments, openings 434.2 are not pre-formed in the base plate of inner member 434. The last opening 434.4 is an optional opening of a filling valve 495. In some embodiments, the device can be filled with pressured gas, or refilled in some cases, via filling valve 495. Exemplary, the filling valve has a unidirectional pressure valve port that can be filled from a canister of compressed gas with a corresponding injection port. In other embodiments, there is no filling valve in the device.

Referring specifically to FIG. 12F, the downward slanting external threads of the inner member are clearly visible. Below the screw threads are two parallel protruding members. The protruding members define a base plate 460 of the inner member. The aforementioned structure is clearly visible in other figures of the inner member as well. An additional gasket 370 surrounds base plate 460, positioned between the protruding member. The gasket is shown in FIGS. 11B, 11C and 11D.

Referring to the cross-sectional views C-C and D-D, a number of elements are clearly visible. Opening 416 is visible in both views. A path 433 from outside the screw threads to the opening 416 is also clearly depicted (see also view A-A). A mouth 435 of the path or tunnel 433 is shown in FIG. 12F. When released, gas flows down the outside of the screw threads—between the screw threads of the inner and outer members 432, 434—into mouth 435 and through the path 433 into the opening 416. The path of the gas flow is shown in FIG. 11E.

Outer member 432 is shown in greater detail in FIG. 13. FIG. 13 is a bottom isometric view of the outer member 432. Channels 432.1 are visible in the Figure. The gas is released when the outer member 432 is unscrewed from inner member 434 which opens a gap between the top of the inner member and the flat rubber seal 436. Thus, a path of fluid communication is formed between the inner volume of the inner member and the proximal end of the needle. The gas travels out of the inner volume 430 and flows between the channels 432.1 and the external screw threads of inner member 434 and enters the path 433 via mouth 435, flowing into opening 416. From the opening in the needle, the gas flows through the needle and out into the cork, forcing the cork from the bottle.

In an alternative configuration, (at least one borehole) boreholes 437 are formed in the top rim of inner member 434. When released, the gas flows out of the inner volume 430 and down the boreholes, into tunnel 433 in a base of said inner member, where the tunnel is in fluid communication with opening 416 in the proximal end of the hollow needle. In embodiments, boreholes 437 are formed in addition to the flow path defined between the screw threads of the inner and outer members.

All of the components discussed above, for all of the preceding embodiments and configurations of the invention, can be formed or made from any applicable materials. Such materials include, but are in no way limited to: any types of synthetic polymers, steel, aluminum, other metals. Components that have been described as separate components (e.g. a base plate and spikes) may be formed, in variations of the embodiments described above, as a single component, and vice versa.

In all of the aforementioned embodiments, the needle may be removal resistant. I.e. a security feature is built into the needle whereby, once inserted, the needle cannot be removed. The security feature ensures that if the device is removed from the cork then there is no sharp needle that can stab into the user accidently.

In one exemplary embodiment, the body of the needle is formed with spines, teeth or wedge-like protrusions that allow the needle to be inserted but prevent the needle from being removed. Additionally or alternatively, the needle make be formed with a weakening either along the body or near the top of the needle. When the user attempts to remove the device, the needle—or at least the sharp point of the needle—breaks off at the weakening and the rest of the needle remains inside the cork.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A device for removing a cork from a bottle, the device comprising:

(a) a hollow needle, adapted to be inserted in the cork; and (b) pressurized gas sealed in an inner volume of a pre-packaged container; wherein said pressurized gas is adapted to be released from said container when a path of fluid communication is formed between a proximal end of said hollow needle and said inner volume of said container, such that said pressurized gas is channeled through said hollow needle, and into the cork or into the bottle, below the cork thereby forcing the cork out of the bottle;

wherein said device has a rest state and a release state, wherein in said rest state, a barrier interposes between said proximal end of said hollow needle and said inner volume, and in said release state said fluid path is formed between said inner volume of said container and said proximal end of said hollow needle, such that said pressurized gas is released from said container into said hollow needle.

2. The device of claim 1, wherein said proximal end is sharp.

3. The device of claim 1, wherein said hollow needle includes:

a first opening at a proximal end of said hollow needle, a second opening at a distal end of said hollow needle, and a channel within said hollow needle connecting said first opening to said second opening, such that when said path is formed, said pressurized gas enters said hollow needle via said first opening and exits said hollow needle via said second opening.

4. The device of claim 1, further comprising:

(c) a safety mechanism, adapted to prevent said path of fluid communication from being formed.

5. The device of claim 1, wherein said device further includes:

a disk with a central aperture through which said proximal end of said hollow need passes there-through;

a spring biasing said disk towards said proximal end of said hollow needle; and an actuating member adapted to push said container against said disk so as to move said disk away from said proximal end, moving said device from said rest state to said release state.

6. The device of claim 1, wherein said container is a single use aluminum capsule and said proximal end of said hollow needle is sharp such that in moving to said release state, said proximal end punctures said single use aluminum capsule, thereby forming said path of fluid communication and releasing said pressurized gas.

7. The device of claim 1, wherein said container includes a pressure valve and said proximal end of said hollow needle activates said pressure valve in said release state, thereby forming said path of fluid communication and releasing said pressurized gas from said container.

8. The device of claim 7, wherein said container is a refill-able container.

9. A device for removing a cork from a bottle, the device comprising:

(a) a hollow needle, adapted to be inserted in the cork; and (b) a pressurized gas sealed in an inner volume of a container; wherein said pressurized gas is adapted to be released from said container when a path of fluid communication is formed between a proximal end of said hollow needle and said inner volume of said container, such that said pressurized gas is channeled through said hollow needle, and into the cork or into the bottle, below the cork thereby forcing the cork out of the bottle;

wherein said device has a rest state and a release state, wherein in said rest state, a barrier interposes between said proximal end of said hollow needle and said inner volume, and in said release state said fluid path is formed between said inner volume of said container and said proximal end of said hollow needle, such that said pressurized gas is released from said container into said hollow needle;

wherein said device is moved from said rest state to said release state by rotating said container about a threaded member until said barrier of said container is penetrated by said proximal end of said hollow needle.

10. The device of claim 9, wherein said safety mechanism includes a safety member, said safety member positioned so as to prevent said container from being rotating sufficiently so as to be penetrated by said proximal end of said hollow need k.

11. The device of claim 9, wherein said container includes:

an outer member, and an inner member, wherein said outer and inner members are adapted to be threadably engaged;

said pressurized gas is disposed within said inner volume defined by said outer and inner members; and wherein said inner member includes said barrier located facing said proximal end of said hollow needle.

12. The device of claim 9, wherein said barrier is a selected from the group including: an aluminum sheet, a rubber barrier, a metal diaphragm, and an impermeable membrane.

13. The device of claim 9, wherein said container includes:

an outer member, and an inner member, said outer and inner members threadably engaged;

wherein said pressurized gas is disposed within an inner volume defined by said outer and inner members; and wherein unscrewing said outer member from said inner member forms said path of fluid communication and releases said pressurized gas from said inner volume.

14. The device of claim 13, wherein said path of fluid communication includes a flow path between internal screw threads of said outer member and external screw threads of said inner member and a tunnel leading from said space flow path to an opening in said proximal end of said hollow needle.

15. The device of claim 13, wherein said path of fluid communication includes at least one borehole disposed in a rim of inner member, connecting with a tunnel in a base of said inner member, said tunnel in fluid communication with said proximal end of said hollow needle.

16. A device for removing a cork from a bottle, the device comprising:

(a) a hollow needle, adapted to be inserted in the cork;

(b) a pressurized gas sealed in an inner volume of a container; wherein said pressurized gas is adjusted to be released from said container when a path of fluid communication is formed between a proximal end of said hollow needle and said inner volume of said container, such that said pressurized gas is channeled through said hollow needle, and into the cork or into the bottle, below the cork thereby forcing the cork out of the bottle; and further comprising an anchoring means for anchoring said hollow needle against rotation about an axis thereof.

17. The device of claim 16, wherein said hollow needle is coupled to a needle holder and wherein said anchoring means includes at least two spikes extending from said needle holder, said at least two spikes adapted to be inserted into the cork when said hollow needle is inserted into the cork.

18. The device of claim 16, wherein said anchoring means includes spines disposed along an outer surface of said hollow needle, said spines adapted to prevent said hollow needle from rotating once inserted into the cork.

19. The device of claim 16, wherein anchoring means is said hollow needle and wherein said hollow needle has an elongated body of a shape selected from the group including: a triangular shape, square shape, oblong shape, pentagonal shape, hexagonal shape.

* * * * *